US010743122B2

(12) United States Patent
Kuhn

(10) Patent No.: US 10,743,122 B2
(45) Date of Patent: Aug. 11, 2020

(54) DOME FOR A HEARING AID DEVICE INSERTABLE INTO AN AUDITORY CANAL, AND HEARING DEVICE

(71) Applicant: SIVANTOS PTE. LTD., Singapore (SG)

(72) Inventor: Johannes Kuhn, Nuremberg (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 16/383,887

(22) Filed: Apr. 15, 2019

(65) Prior Publication Data

US 2019/0320274 A1 Oct. 17, 2019

(30) Foreign Application Priority Data

Apr. 13, 2018 (DE) ..... 10 2018 205 691

(51) Int. Cl.
*H04R 25/00* (2006.01)

(52) U.S. Cl.
CPC ..... *H04R 25/654* (2013.01); *H04R 25/656* (2013.01)

(58) Field of Classification Search
CPC . H04R 25/654; H04R 25/656; H04R 2460/17
USPC ..... 381/325
See application file for complete search history.

(56) References Cited

U.S. PATENT DOCUMENTS 10,462,589 B2 * 10/2019 Higgins ..... H04R 25/654
2019/0110928 A1 * 4/2019 Aase ..... A61F 11/08

FOREIGN PATENT DOCUMENTS

DE 102011115099 B3 1/2013
DE 102014200605 A1 4/2015

* cited by examiner

*Primary Examiner* — Brian Ensey
(74) *Attorney, Agent, or Firm* — Laurence A. Greenberg; Werner H. Stemer; Ralph E. Locher

(57) ABSTRACT

A dome for a hearing aid device that is insertable into an auditory canal. The dome has an inner part and a shield which is produced in one piece with the inner part. A wax guard with at least one protective element is arranged inside an opening of the dome. The protective element is flexibly turnable in a direction of insertion of the dome and counter to the direction of insertion of the dome into an auditory canal. A cleaning element, which is movable in the direction of insertion and counter to the direction of insertion of the dome, is cohesively bonded to the shield. A hearing aid device is embodied with a correspondingly configured dome.

14 Claims, 3 Drawing Sheets

DOME FOR A HEARING AID DEVICE INSERTABLE INTO AN AUDITORY CANAL, AND HEARING DEVICE

CROSS-REFERENCE TO RELATED APPLICATION

This application claims the priority, under 35 U.S.C. § 119, of German patent application DE 10 2018 205 691, filed Apr. 13, 2018; the prior application is herewith incorporated by reference in its entirety.

BACKGROUND OF THE INVENTION

Field of the Invention

The invention relates to a dome for a hearing aid device that is insertable into an auditory canal. The invention further relates to a hearing aid device with a corresponding dome.

The term hearing aid device generally designates a portable hearing device which serves to improve the perception of the ambient sound impinging on the ear of a user. A subclass of hearing aid devices, referred to classically as "hearing devices," is provided to aid individuals who suffer from hearing loss in the medical sense. In order to meet their many individual needs, different structural types of hearing devices are offered, such as the behind-the-ear hearing devices (BTE), hearing devices with an external receiver (RIC, receiver-in-canal), in-the-ear hearing devices (ITE), or also concha hearing devices or in-canal hearing devices (ITE, CIC, completely-in-the-canal). The hearing devices listed as examples are worn on the outer ear or in the auditory canal. In addition, bone conduction hearing aids and implantable or vibrotactile hearing aids are also available on the market. In these hearing aids, the damaged hearing faculty is stimulated either mechanically or electrically.

To ensure that the part of the hearing aid device to be worn in the ear is supported inside the ear canal, or auditory canal, in such a way that it has a secure fit and provides a high degree of wearing comfort for prolonged use, the hearing (aid) device is usually provided with a dome, which has a shield that is flexibly adaptable to the auditory canal.

Customary domes are made of silicone and, in order to ensure the passage of sound through the domes, are provided with at least one acoustic opening. To prevent soiling of the dome and therefore of the hearing device with earwax (cerumen), the acoustic opening can be provided with a sound-transmitting membrane. However, this membrane serving for protection against wax may itself likewise become soiled or clogged with wax. The then necessary cleaning of the dome or the replacement of the wax guard or membrane is often complicated and, in particular, cannot be done by the end user alone. Moreover, the insertion of bridge elements into the acoustic openings does not offer complete protection against soiling.

BRIEF SUMMARY OF THE INVENTION

It is accordingly an object of the invention to provide a dome for a hearing device to be inserted into an ear canal which overcomes the above-mentioned and other disadvantages of the heretofore-known devices and methods of this general type and which improves the protection of a hearing aid device against undesired soiling while at the same time permitting simplified cleaning.

With the foregoing and other objects in view there is provided, in accordance with the invention, a dome for a hearing aid device that is insertable into an auditory canal, the dome comprising:

an inner part;

a shield integrally formed in one piece with said inner part and having an opening formed therein;

a wax guard with at least one protective element disposed inside said opening, said protective element being flexibly turnable in and counter to a direction of insertion of the dome into the auditory canal; and a cleaning element cohesively bonded to said shield and disposed to be movable in the direction of insertion and counter to the direction of insertion of the dome.

In other words, the dome according to the invention for a hearing aid device insertable into an auditory canal comprises an inner part and a shield which is produced in one piece with the inner part and has at least one opening. A wax guard with at least one protective element is arranged inside the opening, said protective element being flexibly turnable in and counter to the direction of insertion of the dome into an auditory canal. According to the invention, a cleaning element, which is movable in and counter to the direction of insertion of the dome, is cohesively bonded to the shield. The term cohesive bonding relates to a material bond, i.e., a connection where the adjoining materials merge into one another on a molecular and matrix level. Examples of such a bond are welding, vulcanizing, etc.

Through the use of a dome with a suitably configured cleaning element, it is possible for the wearer of the respective hearing aid device to clean the latter with minimal effort. Additional cleaning tools can be dispensed with, and it is not necessary to replace components of the dome. The flexible reversibility of the at least one protective element allows it to be moved both in and also counter to the direction of insertion of the dome into an auditory canal. Thus, the cleaning element can advantageously be moved into the position provided for cleaning purposes and, after the cleaning has been carried out, can be moved back to the starting position. On account of the cohesively bonded connection of the cleaning element to the shield of the dome, the positioning of the individual components of the dome with respect to one another is fixed. There is no danger of the individual components slipping out of place.

Preferably, the cleaning element is cohesively bonded to the at least one protective element. Moreover, the wax guard is preferably cohesively bonded to the shield of the dome. The cleaning element is thus connected to the shield via the at least one protective element of the wax guard. Within the context of the invention, the entire dome, with the shield, the inner part, the wax guard (including the or each protective element) and the cleaning element, is produced in one piece. The dome is preferably made of a flexible material, for example a thermoplastic elastomer or silicone.

In a further preferred embodiment, the at least one protective element is curved in the direction of insertion of the dome. The curved design ensures the mobility of the protective element in and counter to the direction of insertion of the dome and thus likewise allows the cleaning element, cohesively bonded to the protective element, to move in and counter to the direction of insertion of the dome.

To be able to move the cleaning element in and counter to the direction of insertion of the dome, the cleaning element preferably comprises an actuating element. The actuating element has in particular a rod-shaped configuration. Preferably, the actuating element extends in the direction of insertion through the at least one opening formed in the shield. In this way, the actuating element can be accessed by the wearer of the hearing aid from the outside of the shield and allows the wearer to thus use the cleaning element and carry out a cleaning process without additional cleaning tools.

The at least one protective element is preferably cohesively bonded to the actuating element of the cleaning element and is thus movable via the actuating element in and counter to the direction of insertion of the dome. For this purpose, the at least one protective element comprises a foot which, in relation to the direction of insertion, extends in a radial direction into the opening of the shield and is cohesively bonded to the actuating element. A movement of the actuating element thus causes a movement of the at least one protective element.

In a preferred embodiment, the cleaning element has, in relation to the direction of insertion, at least one wing extending outward in the radial direction. This at least one wing is preferably likewise cohesively bonded to the actuating element of the cleaning element and preferably extends from the actuating element into the opening of the shield. When the actuating element is moved for example in the direction of insertion of the dome, the cohesively bonded connection between wing and actuating element means that the at least one protective element also moves in this direction.

The peripheral surface of the at least one wing of the cleaning element advantageously comes to bear in this case, i.e. during movement of the actuating element, on the inner circumferential surface of the opening of the shield. Further preferably, the side faces of the at least one wing of the cleaning element come to bear on the side faces of the protective element during movement of the actuating element. In this way, all dirt and deposits that have accumulated in the opening of the shield are pushed out of the opening by the wing of the cleaning element and can be removed.

In principle, the number of the protective elements of the wax guard and the number of the wings of the cleaning element is not limited. In an expedient embodiment, the wax guard has as many protective elements as the cleaning element has wings. In particular, the wax guard is configured with at least two protective elements spaced apart from each other, and the cleaning element has at least two wings which, during a movement of the actuating element, engage in the gaps formed by the spacing apart of the protective elements. Here too, the peripheral surfaces of the wings inside the gaps expediently bear on the inner circumferential surface of the opening of the shield, and the side faces of the wings come to bear on the side faces of the of the protective element adjacent to them during movement of the actuating element.

The hearing aid device according to the invention comprises a dome having the features of the claims described above. By using a dome of this kind produced in one piece and with an integrated cleaning tool, it is additionally possible to do without cleaning tools. Replacement of the dome or the wax guard is also unnecessary.

A hearing aid device within the meaning of the invention is understood to mean, among other things, headsets and, in particular, traditional hearing devices. The hearing device itself preferably comprises at least one microphone, a signal processor with an amplifier and a receiver, and also further electronic and functional components. The dome of the hearing aid device according to the invention is preferably positioned at or on the part of the respective hearing aid device that is worn in the auditory canal.

The advantages and preferred embodiments described for the dome according to the invention apply equally to the hearing aid device according to the invention and may accordingly be carried over analogously to the latter.

Other features which are considered as characteristic for the invention are set forth in the appended claims.

Although the invention is illustrated and described herein as embodied in a dome for a hearing aid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
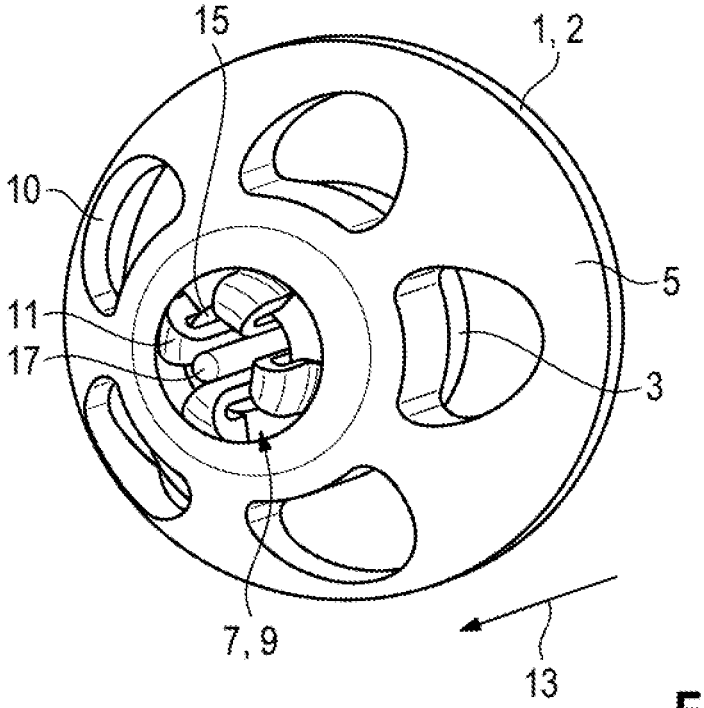
FIG. 1 is a perspective view of a dome with a cleaning element according to the invention.

Referring now to the figures of the drawing in detail and first, particularly, to FIG. 1 thereof, there is shown a three-dimensional view of a dome 1 as a constituent part of a hearing aid device 2 insertable into an auditory canal. The dome 1 comprises an inner part 3, and a shield 5 produced integrally in one piece with the inner part 3. The shield 5 has an opening 7 inside which a wax guard 9 is arranged. Moreover, the shield 5 has five openings 10 for open supply. The wax guard 9 is integrally produced in one piece with the shield 5 of the dome 1. The wax guard 9 comprises four protective elements 11 which are flexibly turnable in and counter to the direction of insertion 13 of the dome 1 into an auditory canal. The protective elements 11 are curved in the direction of insertion 13 of the dome 1 and are spaced uniformly apart from one another over the periphery of the wax guard 9. Since the protective elements 11 are spaced apart from one another, gaps 15 are formed between them.

Moreover, the dome 1 comprises a cleaning element 17 which is movable in and counter to the direction of insertion 13 of the dome 1. The cleaning element 17 is cohesively bonded to the protective elements 11 of the wax guard 9 and thus also to the shield 5.

Figure 2:
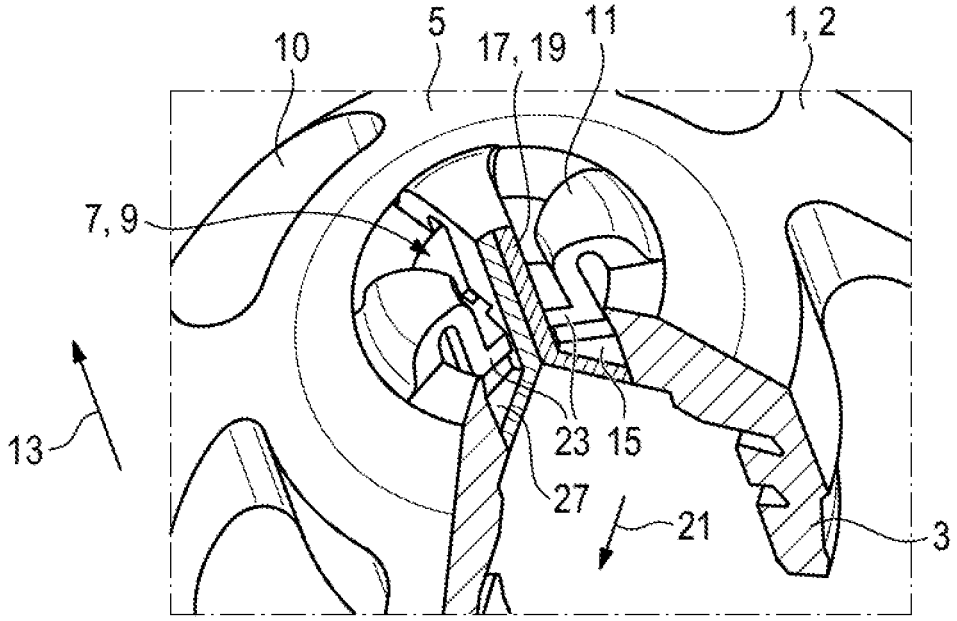
FIG. 2 is a perspective, partly cut-away view of a detail of the dome of FIG. 1.

The cleaning element 17 and its cohesively bonded connection to the protective elements 11 can be seen in FIG. 2. The cohesively bonded connection is achieved via an actuating element 19 of the cleaning element 17. In the present case, the actuating element 19 is rod-shaped and extends, in the direction of insertion 13, through the opening 7 formed in the shield 5. The protective elements 11 each comprise a foot 23 which, in relation to the direction of insertion 13, extends in a radial direction 21 into the opening 7 of the shield 5 and is cohesively bonded to the actuating element 19. The cleaning element 17 itself and also the four protective elements 11 of the wax guard 9 can be moved in and counter to the direction of insertion 13 of the dome 1 via the actuating element 19.

Moreover, the cleaning element 17 has, in relation to the direction of insertion 13 of the dome 1, in the present case four wings 27 extending outward in the radial direction 21. Three of the four wings 27 can be seen in the detail of the dome 1 according to FIG. 2. The wings 27 of the cleaning element 17 are produced in one piece with the actuating element 19 and are likewise spaced uniformly apart from one another on the latter.

Figure 3:
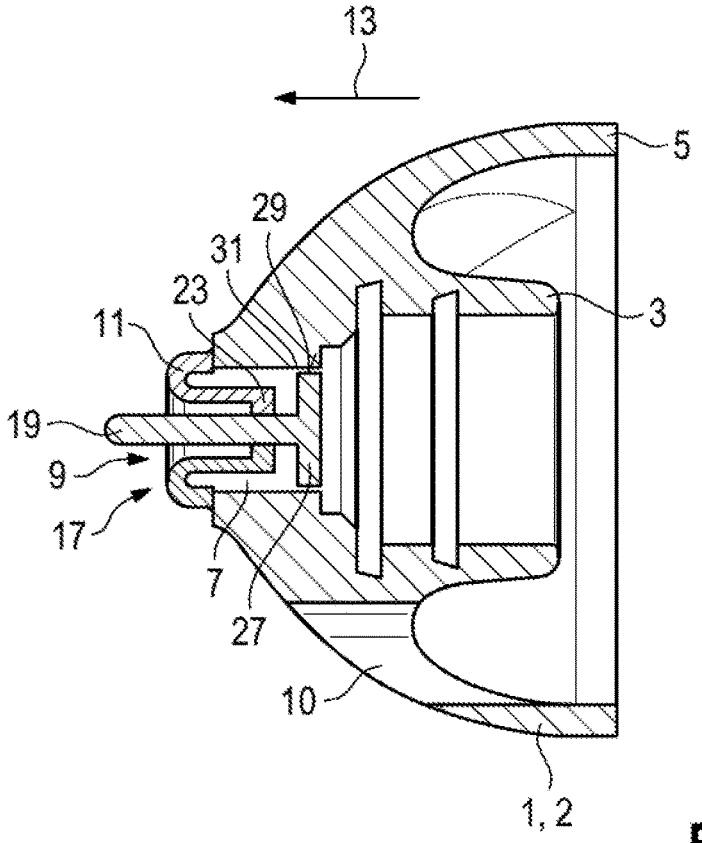
FIG. 3 is a longitudinal section through the dome according to FIG. 1.

During a movement of the actuating element 19 in the direction of insertion 13 of the dome 1, the wings 27 of the cleaning element 17 engage in the gaps 15 formed by the spacing apart of the protective elements 11. Here, the peripheral surfaces 29 of the wings 27 inside the gaps 15 come to bear on the inner circumferential surface 31 of the opening 7 of the shield 5. This can be seen from the views of the dome according to FIGS. 3 and 4. Moreover, the cohesively bonded connection of the protective elements 11 to the cleaning element 17 can be seen clearly in the longitudinally sectioned view according to FIG. 3. The feet 23 of the protective elements 11 are each cohesively bonded to the actuating element 19 of the cleaning element 17.

Figure 4:
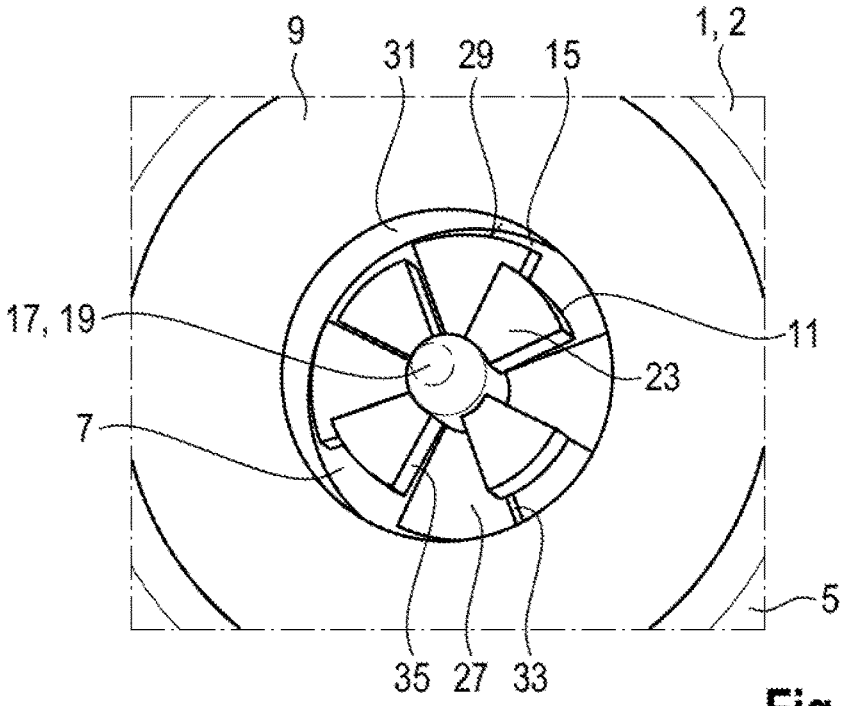
FIG. 4 shows the dome according to FIG. 1 in a cross section.

The cross section of the dome according to FIG. 4 additionally shows that, upon engagement of the wings 27 of the cleaning element 17 in the gaps 15 formed between the protective elements 11 (upon actuation of the actuating element), the side faces 33 of the wings 27 come to bear on the side faces 35 of the protective elements 11 adjacent to them.

Figure 5:
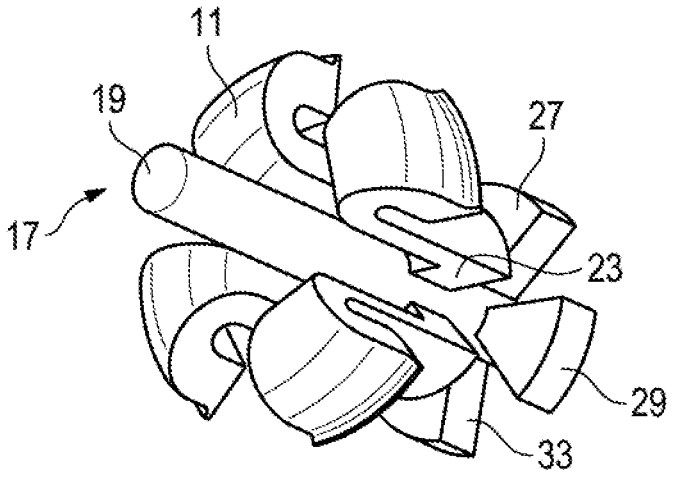
FIG. 5 shows a perspective, three-dimensional view of a partial region of the dome according to FIG. 1.
Figure 6:
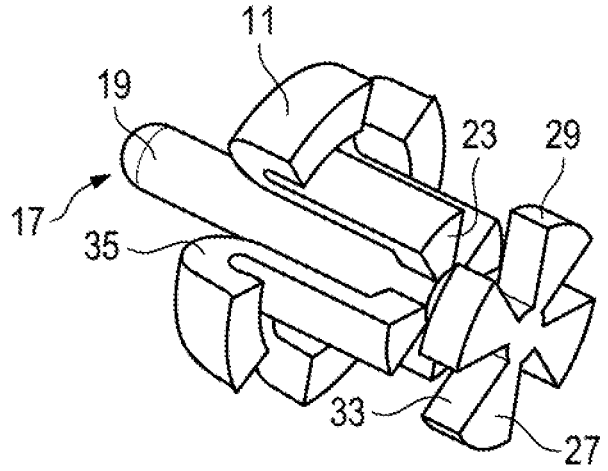
FIG. 6 shows a further perspective, three-dimensional view of the partial region of the dome according to FIG. 1.

The further three-dimensional views according to FIGS. 5 and 6 each show the four protective elements 11 of the wax guard 9 together with the cleaning element 17. The views show dearly the cohesively bonded connection of the feet 23 of the respective protective elements 11 to the actuating element 19 of the cleaning element 17.

The entire dome 1, with the shield 5, the inner part 3, the wax guard 9, the presently four protective elements 11 and the cleaning element 17, is produced in one piece from a thermoplastic elastomer.

Although the invention will have been made particularly clear from the illustrative embodiments described above, it is not limited to these illustrative embodiments. Instead, further embodiments of the invention may be derived from the claims and from the above description.

The following is a summary list of reference numerals and the corresponding structure used in the above description of the invention:

1 dome
2 hearing aid device
3 inner part
5 shield
7 opening
9 wax guard
10 opening
11 protective element
13 direction of insertion
15 gap
17 cleaning element
19 actuating element
21 radial direction
23 foot
27 wing
29 peripheral surface
31 inner circumferential surface
33 side face of wing
35 side face of protective element

The invention claimed is:

1. A dome for a hearing aid device that is insertable into an auditory canal, the dome comprising:

an inner part;

a shield integrally formed in one piece with said inner part and having an opening formed therein;

a wax guard with at least one protective element disposed inside said opening, said protective element being flexibly turnable in and counter to a direction of insertion of the dome into the auditory canal; and a cleaning element cohesively bonded to said shield and disposed to be movable in the direction of insertion and counter to the direction of insertion of the dome.

2. The dome according to claim 1, wherein said cleaning element is cohesively bonded to said at least one protective element.

3. The dome according to claim 1, wherein said at least one protective element is curved in the direction of insertion of the dome.

4. The dome according to claim 1, wherein said cleaning element comprises an actuating element, by way of which said cleaning element is movable in the direction of insertion and counter to the direction of insertion of the dome.

5. The dome according to claim 4, wherein said actuating element extends, in the direction of insertion, through the at least one opening formed in said shield.

6. The dome according to claim 4, wherein said at least one protective element is movable in the direction of insertion and counter to the direction of insertion of the dome via said actuating element.

7. The dome according to claim 1, wherein said at least one protective element comprises a foot which, with reference to the direction of insertion, extends in a radial direction into said opening of said shield and is cohesively bonded to said actuating element.

8. The dome according to claim 1, wherein said cleaning element has at least one wing which, with reference to the direction of insertion, extends outward in a radial direction.

9. The dome according to claim 8, wherein said at least one wing of said cleaning element has a peripheral surface that comes to bear on an inner circumferential surface of said opening of said shield during a movement of said actuating element.

10. The dome according to claim 9, wherein said at least one wing has side faces that come to bear on said side faces of said at least one protective element during the movement of said actuating element.

11. The dome according to claim 10, wherein said at least one protective element of said wax guard is one of at least two protective elements spaced apart from each other, and said cleaning element has at least two wings which, during a movement of said actuating element, engage in gaps formed between said spaced-apart protective elements.

12. The dome according to claim 8, wherein said at least one wing of said cleaning element has side faces that come to bear on said side faces of said at least one protective element during a movement of said actuating element.

13. The dome according to claim 8, wherein said at least one protective element of said wax guard is one of at least two protective elements spaced apart from each other, and said cleaning element has at least two wings which, during a movement of said actuating element, engage in gaps formed between said spaced-apart protective elements.

14. A hearing aid device, comprising a dome according to claim 1.

* * * * *